US011705664B2

(12) United States Patent
Liao et al.

(10) Patent No.: US 11,705,664 B2
(45) Date of Patent: Jul. 18, 2023

(54) WATERPROOF SOCKET CONNECTOR

(71) Applicant: Cheng Uei Precision Industry Co., LTD., New Taipei (TW)

(72) Inventors: Ting-Feng Liao, New Taipei (TW); Chun-Fu Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 75 days.

(21) Appl. No.: 17/477,523

(22) Filed: Sep. 16, 2021

(65) Prior Publication Data

US 2022/0216643 A1 Jul. 7, 2022

(30) Foreign Application Priority Data

Jan. 6, 2021 (CN) ..... 202120026450.3

(51) Int. Cl.

| | |
|---|---|
| ***H01R 13/40*** | (2006.01) |
| ***H01R 13/52*** | (2006.01) |
| ***H01R 13/405*** | (2006.01) |
| *H01R 13/66* | (2006.01) |

(52) U.S. Cl.

CPC ..... *H01R 13/5202* (2013.01); *H01R 13/405* (2013.01); *H01R 13/6616* (2013.01)

(58) Field of Classification Search

CPC ..... H01R 13/405; H01R 13/5202; H01R 13/6616

USPC ..... 439/589

See application file for complete search history.

(56) References Cited

U.S. PATENT DOCUMENTS

| | | | | |
|---|---|---|---|---|
| 9,660,373 | B2 * | 5/2017 | Tsai | H01R 13/5202 |
| 9,742,098 | B2 * | 8/2017 | Zhao | H01R 13/5202 |
| 9,843,128 | B2 * | 12/2017 | Tsai | H01R 13/5202 |
| 9,865,962 | B2 * | 1/2018 | Zhao | H01R 13/6585 |
| 9,960,522 | B2 * | 5/2018 | Tada | H01R 13/521 |
| 9,997,865 | B2 * | 6/2018 | Yao | H01R 13/6585 |
| 10,063,005 | B2 * | 8/2018 | Zhao | H01R 13/6595 |
| 10,063,015 | B2 * | 8/2018 | Zhao | H01R 13/6593 |
| 10,074,924 | B2 * | 9/2018 | Yamanaka | H01R 13/5202 |
| 10,483,696 | B2 * | 11/2019 | Zhao | H01R 13/035 |
| 10,498,070 | B2 * | 12/2019 | Zhou | H01R 13/5202 |
| 10,804,643 | B2 * | 10/2020 | Tada | H01R 13/41 |
| 10,819,062 | B2 * | 10/2020 | Hsu | H01R 13/5202 |
| 10,971,854 | B2 * | 4/2021 | Tanaka | H01R 13/6596 |

(Continued)

*Primary Examiner* — Abdullah A Riyami
*Assistant Examiner* — Vladimir Imas
(74) *Attorney, Agent, or Firm* — Cheng-Ju Chiang

(57) ABSTRACT

A waterproof socket connector includes an inner insulator, a plurality of terminals fastened in the inner insulator, at least one resistor, a conductive element, a grounding element, a shell, a sealing element and an outer insulator. The plurality of the terminals are a plurality of charging terminals and detection terminals. The at least one resistor is mounted to the detection terminals. The charging terminals are connected to the conductive element. The detection terminals are connected to the grounding element. The charging terminals are connected to the grounding element. The shell surrounds the inner insulator. A rear end of the shell is hollow to form an inner space. The sealing element is filled in the inner space. The outer insulator surrounds the inner insulator, the plurality of the terminals, the shell, the sealing element, the at least one resistor, the conductive element and grounding element.

17 Claims, 15 Drawing Sheets

(56) References Cited

U.S. PATENT DOCUMENTS

| | | | | |
|---|---|---|---|---|
| 11,056,823 | B2 * | 7/2021 | Suzuki | H01R 13/521 |
| 11,152,749 | B2 * | 10/2021 | Xu | H01R 13/5216 |
| 11,165,191 | B2 * | 11/2021 | Choi | H01R 24/60 |
| 2021/0119377 | A1 * | 4/2021 | Hsu | H01R 13/5202 |
| 2021/0119384 | A1 * | 4/2021 | Kawasaki | H01R 13/5202 |

* cited by examiner

WATERPROOF SOCKET CONNECTOR

CROSS-REFERENCE TO RELATED APPLICATION

The present application is based on, and claims priority from, China Patent Application No. 202120026450.3, filed Jan. 6, 2021, the disclosure of which is hereby incorporated by reference herein in its entirety.

BACKGROUND OF THE INVENTION

1. Field of the Invention

The present invention generally relates to a waterproof socket connector, and more particularly to a waterproof socket connector which has a waterproof function and is easy to be assembled with an electronic device.

2. The Related Art

Referring to FIG. 15, a charging circuit that complies with a criterion of a USB (Universal Serial Bus) Type C sink configuration channel functional model, the charging circuit has a connection end. The connection end is equipped with a first conductive terminal, a first ground terminal and two detection terminals. The first conductive terminal, the first ground terminal and the two detection terminals are connected to a resistance for monitoring a working mode of a plug connector. The working mode of the plug connector is a signal mode, a power mode or a fast charging mode.

A conventional socket connector includes a plurality of contact elements. The conventional socket connector is used to an electronic product. The electronic product includes a second conductive terminal and a second ground terminal. When the conventional socket connector is assembled to the electronic product, the plurality of the contact elements of the conventional socket connector need soldering with the second conductive terminal and the second ground terminal of the electronic product, and then the conventional socket connector and the electronic product is usable. However, the electronic product requires a waterproof performance and a high sealing performance, so a soldering procedure between the electronic product and the conventional socket connector is hardly operated. As a result, the electronic product and the conventional socket connector are assembled inconveniently.

In view of the above-mentioned problems, if the charging circuit is integrated to the conventional socket connector, the conventional socket connector may be directly assembled into the electronic product by designing an insertion space of the electronic product, so that the conventional socket connector and the electronic product have no need to proceed with the hard soldering operation between the conventional socket connector and the electronic product.

Therefore, it is necessary to provide a waterproof socket connector which has a waterproof function and is easy to be assembled with an electronic device.

SUMMARY OF THE INVENTION

An object of the present invention is to provide a waterproof socket connector. The waterproof socket connector includes an inner insulator having a tongue board, a plurality of terminals fastened in the inner insulator, at least one resistor, a conductive element, a grounding element, a shell, a sealing element and an outer insulator. The plurality of the terminals are arranged in an upper row and a lower row, respectively. The upper row of the terminals is exposed outside from an upper surface of the tongue board. The lower row of the terminals is exposed outside from a lower surface of the tongue board. A tail end of each terminal has a connecting portion, and each connecting portion projects outward from a rear surface of the inner insulator. The plurality of the terminals are a plurality of charging terminals and detection terminals. The at least one resistor is mounted to the connecting portions of the detection terminals. The conductive element is mounted behind the plurality of the terminals. Several of the charging terminals are connected to the conductive element. The grounding element is mounted behind the plurality of the terminals. The detection terminals are connected to the grounding element. Remains of the charging terminals are connected to the grounding element. A front end of the shell surrounds the inner insulator. A rear end of the shell is hollow to form an inner space between a rear end of the inner insulator and the rear end of the shell. One side of a rear edge of the shell extends rearward to form a grounding part. The grounding part is connected to the grounding element. The sealing element is filled in the inner space. The outer insulator surrounds the inner insulator, the plurality of the terminals, the shell, the sealing element, the at least one resistor, a front end of the conductive element and a front end of the grounding element.

Another object of the present invention is to provide a waterproof socket connector. The waterproof socket connector includes an inner insulator having a tongue board, a plurality of terminals, a circuit board, at least one resistor, a conductive element, a grounding element, a shell, a sealing element and an outer insulator. The plurality of the terminals are fastened in the inner insulator. The plurality of the terminals are arranged in an upper row and a lower row, respectively. The upper row of the terminals is exposed outside from an upper surface of the tongue board. The lower row of the terminals is exposed outside from a lower surface of the tongue board. A tail end of each terminal has a connecting portion, and each connecting portion projects outward from a rear surface of the inner insulator. The plurality of the terminals are a plurality of charging terminals and detection terminals. The circuit board is mounted to the tail ends of the plurality of the terminals, and the circuit board is connected with the connecting portions of the plurality of the terminals. The at least one resistor is fastened to the circuit board. The conductive element is mounted to a rear of the circuit board, and the conductive element is connected to the circuit board. The grounding element is mounted to the rear of the circuit board, and the grounding element is connected to the circuit board. A front end of the shell surrounds the inner insulator. A rear end of the shell is hollow to form an inner space between a rear end of the inner insulator and the rear end of the shell. The sealing element is filled in the inner space. The outer insulator surrounds the inner insulator, the plurality of the terminals, the shell, the sealing element, the circuit board, the at least one resistor, a front end of the conductive element and a front end of the grounding element.

Another object of the present invention is to provide a waterproof socket connector. The waterproof socket connector includes an inner insulator, a plurality of terminals, a circuit board, at least one resistor, a conductive pin, a grounding pin, a shell, a sealing element and an outer insulator. The plurality of the terminals are fastened in the inner insulator. The plurality of the terminals are arranged in an upper row and a lower row, respectively. A tail end of each terminal has a connecting portion, and each connecting portion projects outward from a rear surface of the inner insulator. The plurality of the terminals are a plurality of charging terminals and detection terminals. The at least one resistor is directly mounted to the connecting portions of the detection terminals. The conductive pin is positioned behind the plurality of the terminals. Several of the charging terminals are connected to the conductive pin. The grounding pin is positioned behind the plurality of the terminals. The detection terminals are directly connected to the grounding pin. Remains of the charging terminals are directly connected to the grounding pin. A front end of the shell surrounds the inner insulator. A rear end of the shell is hollow to form an inner space between a rear end of the inner insulator and the rear end of the shell. One side of a rear edge of the shell extends rearward to form a grounding part. The grounding part is directly connected to the grounding pin. The sealing element is filled in the inner space. The outer insulator surrounds the inner insulator, the plurality of the terminals, the shell, the sealing element, the at least one resistor, a front end of the conductive pin and a front end of the grounding pin.

As described above, the conductive element and the grounding element of the waterproof socket connector are connected to the at least one resistor and the plurality of the terminals of the waterproof socket connector directly or the conductive element and the grounding element are connected to the at least one resistor and the plurality of the terminals through the circuit board, so the waterproof socket connector not only has a waterproof function and a charging function, but also is easy to be assembled with an electronic device.

DETAILED DESCRIPTION OF THE PREFERRED EMBODIMENT

Figure 1:
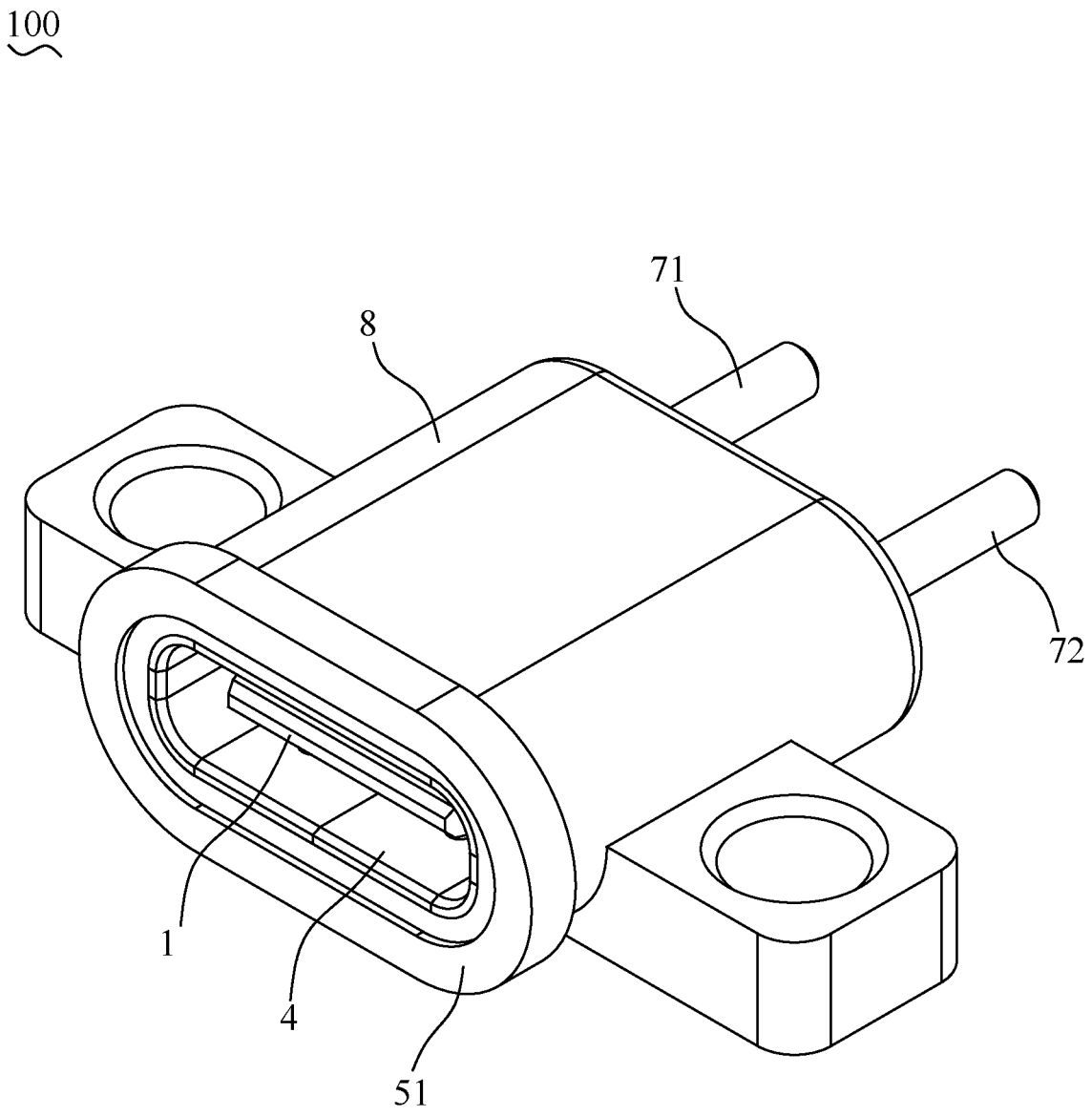
FIG. 1 is a perspective view of a waterproof socket connector in accordance with the present invention.
Figure 2:
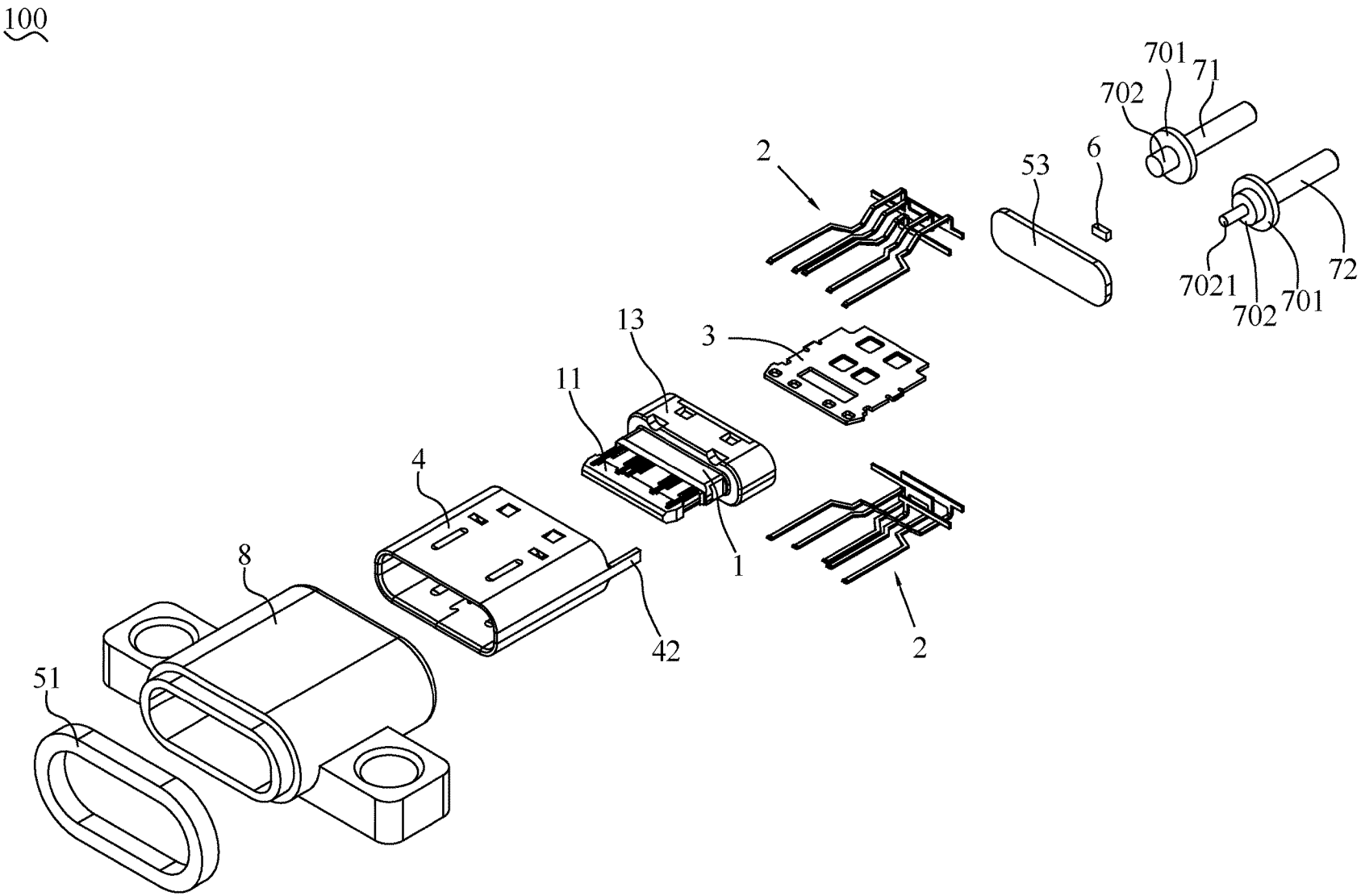
FIG. 2 is an exploded view of the waterproof socket connector in accordance with a first preferred embodiment of the present invention.

Referring to FIG. 1 and FIG. 2, a waterproof socket connector 100 in accordance with the present invention is shown. The waterproof socket connector 100 includes an inner insulator 1, a plurality of terminals 2, a reinforcement plate 3, a shell 4, a sealing element 53, at least one resistor 6, a conductive element 71, a grounding element 72 and an outer insulator 8. The conductive element 71 and the grounding element 72 are shown as substantially cylinder shapes.

Referring to FIG. 1 and FIG. 2, the waterproof socket connector 100 in accordance with a first preferred embodiment of the present invention is shown. In the first preferred embodiment, the inner insulator 1 has a base body 13, and a tongue board 11 protruded frontward from a middle of a front surface of the base body 13.

Figure 3:
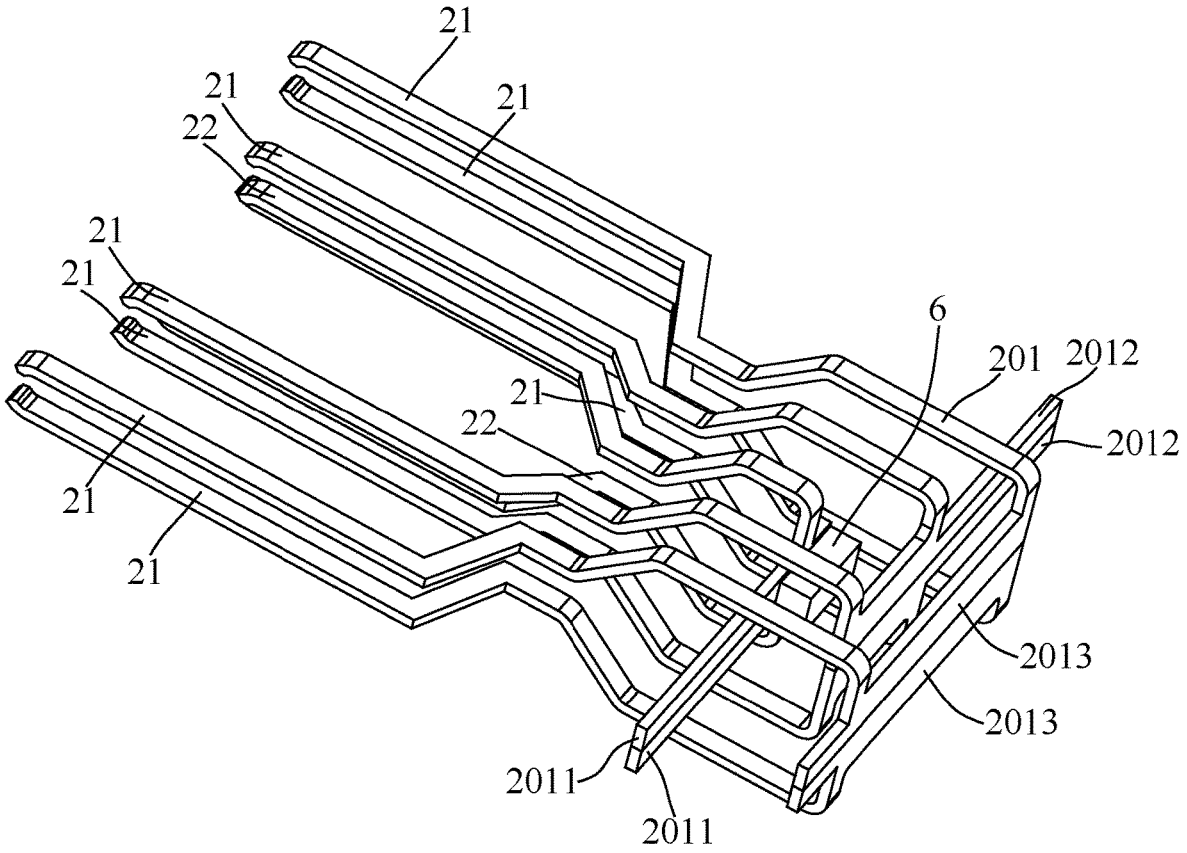
FIG. 3 is a perspective view of a plurality of terminals of the waterproof socket connector of FIG. 2.

Referring to FIG. 2 and FIG. 3, the plurality of the terminals 2 are fastened in the inner insulator 1. The plurality of the terminals 2 are arranged in an upper row and a lower row, respectively. The upper row of the terminals 2 are fastened in an upper portion of the inner insulator 1. The lower row of the terminals 2 are fastened in a lower portion of the inner insulator 1. The upper row of the terminals 2 are exposed outside from an upper surface of the tongue board 11. The lower row of the terminals 2 are exposed outside from a lower surface of the tongue board 11. A tail end of each terminal 2 has a connecting portion 201 at the end of each terminal 2, and each connecting portion 201 projects outward from a rear surface of the inner insulator 1.

The waterproof socket connector 100 is mainly used for a charging purpose, so only charging terminals 21 and detection terminals 22 are retained. The waterproof socket connector 100 includes ten terminals 2 in total, and the ten terminals 2 are divided into two rows. The plurality of the terminals 2 are the ten terminals 2. The two rows of the terminals 2 are the upper row of the terminals 2 and the lower row of the terminals 2. Five terminals 2 are arranged in the upper row, and the other five terminals 2 are arranged in the lower row. The upper row of the terminals 2 are disposed corresponding to the lower row of the terminals 2. The lower row of the terminals 2 are located under the upper row of the terminals 2. The plurality of the terminals 2 are the charging terminals 21 and the detection terminals 22. The plurality of the terminals 2 include eight charging terminals 21 and two detection terminals 22. Each row of the terminals 2 include four charging terminals 21 and one detection terminal 22. Each detection terminal 22 is located in a middle of the plurality of the terminals 2, so each side of the detection terminal 22 of each row is disposed adjacent to two charging terminals 21.

The reinforcement plate 3 is mounted in the inner insulator 1, and the reinforcement plate 3 is positioned between the two rows of terminals 2 for enhancing a structure strength of the tongue board 11. The reinforcement plate 3 is made of a stainless steel.

Figure 4:
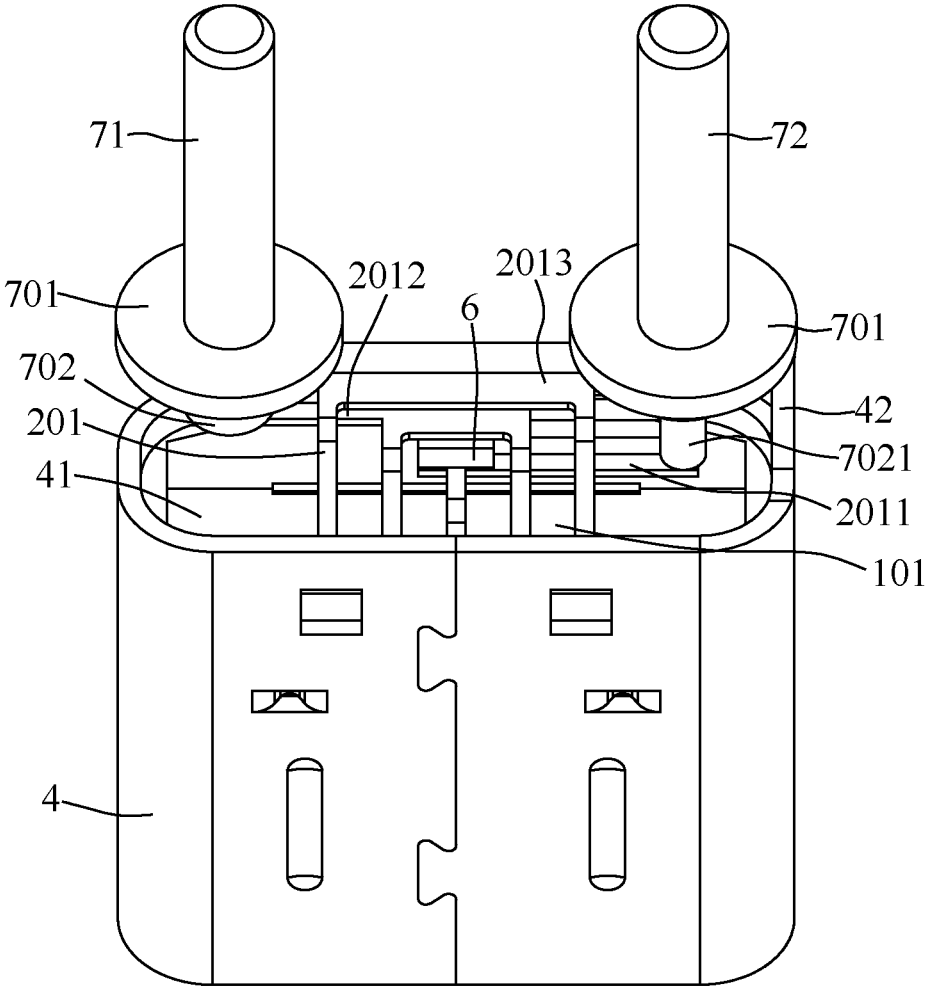
FIG. 4 is a partial assembling view of the waterproof socket connector, wherein a sealing element is without being filled in the waterproof socket connector of FIG. 2.
Figure 5:
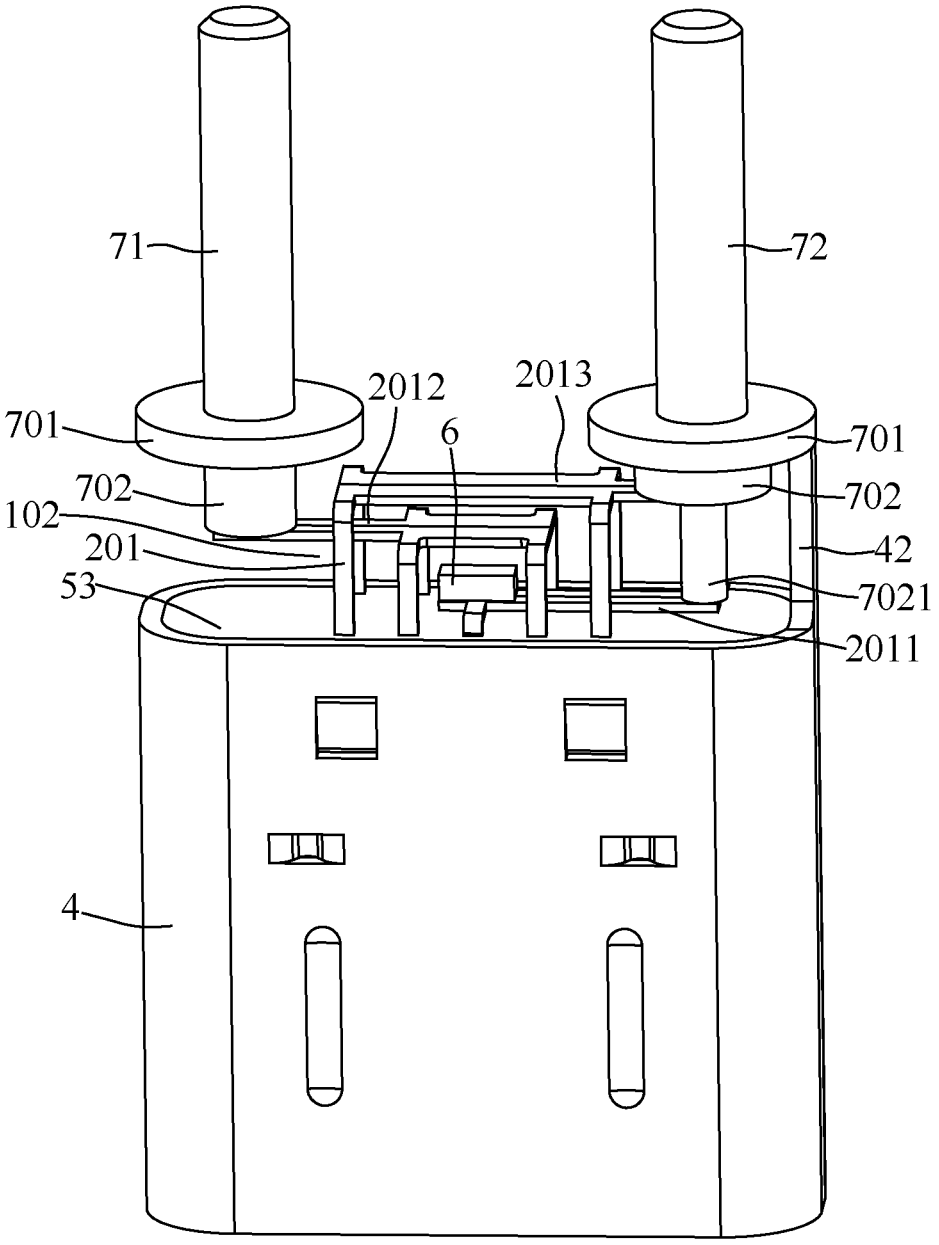
FIG. 5 is a partial assembling view of the waterproof socket connector, wherein the sealing element is filled in the waterproof socket connector of FIG. 2.

Referring to FIG. 2 to FIG. 4, a front end of the shell 4 surrounds the inner insulator 1. A rear end of the shell 4 is hollow to form an inner space 41 between a rear end of the inner insulator 1 and the rear end of the shell 4. The connecting portions 201 of the plurality of the terminals 2 project outward of the shell 4 through the inner space 41.

Referring to FIG. 2 to FIG. 5, the sealing element 53 is filled in the inner space 41. The sealing element 53 is filled in a gap 101 among the inner insulator 1, the plurality of terminals 2 and the shell 4 for achieving a waterproof effect of the waterproof socket connector 100. The sealing element 53 is a waterproof adhesive.

The at least one resistor 6 is mounted to the connecting portions 201 of the two detection terminals 22. The at least one resistor 6 is directly mounted to the connecting portions 201 of the two detection terminals 22 together by virtue of a forming design of each detection terminal 22. When the waterproof socket connector 100 includes two resistors 6, the two resistors 6 are fastened to the two connecting portions 201 of the two detection terminals 22, respectively.

The conductive element 71 and the grounding element 72 are mounted behind the inner insulator 1 and the plurality of the terminals 2. The conductive element 71 is a conductive pin. The grounding element 72 is a grounding pin. The conductive element 71 and the grounding element 72 are connected to the tail ends of the plurality of the terminals 2. Several of the charging terminals 21 are connected to the conductive element 71 which is the conductive pin. The detection terminals 22 are directly connected to the grounding element 72 which is the grounding pin. Remains of the charging terminals 21 are directly connected to the grounding element 72 which is the grounding pin. The conductive element 71 and the grounding element 72 are connected to the at least one resistor 6 and the plurality of the terminals 2 directly. The grounding pin is positioned behind the plurality of the terminals 2.

Referring to FIG. 1 to FIG. 5, the outer insulator 8 surrounds the inner insulator 1, the plurality of the terminals 2, the reinforcement plate 3, the shell 4, the sealing element 53, the at least one resistor 6, a front end of the conductive element 71 which is the conductive pin and a front end of the grounding element 72 which is the grounding pin to seal up interstices 102 among the inner insulator 1, the plurality of the terminals 2, the reinforcement plate 3, the shell 4, the sealing element 53, the at least one resistor 6, the front end of the conductive element 71 and the front end of the grounding element 72 for achieving the waterproof effect of the waterproof socket connector 100. The waterproof socket connector 100 further includes a waterproof gasket 51. The waterproof gasket 51 is mounted around a front end of the outer insulator 8. When the waterproof socket connector 100 is assembled in an electronic device (not shown), the waterproof gasket 51 seals up an interval between the waterproof socket connector 100 and the electronic device for improving the waterproof effect of the waterproof socket connector 100.

Referring to FIG. 2, a periphery of a front end of each of the conductive element 71 and the grounding element 72 has a blocking wall 701 protruding outward. The blocking wall 701 is shown as a ring shape, and the blocking wall 701 is fastened around the periphery of the front end of each of the conductive element 71 and the grounding element 72. The two blocking walls 701 of the conductive element 71 and the grounding element 72 are molded in the outer insulator 8. After the outer insulator 8 is molded to the two blocking walls 701 of the conductive element 71 and the grounding element 72, the outer insulator 8 surrounds the blocking walls 701 of the conductive element 71 and the grounding element 72, the two blocking walls 701 prevent the conductive element 71 and the grounding element 72 from breaking away from the outer insulator 8 so as to maintain fastening the two front ends of the conductive element 71 and the grounding element 72 in the outer insulator 8. The two front ends of the conductive element 71 and the grounding element 72 protrude frontward to form two soldering portions 702 projecting beyond two front surfaces of the two blocking walls 701 of the conductive element 71 and the grounding element 72. A middle of the soldering portion 702 of the grounding element 72 extends frontward to form a first extension portion 7021.

Referring to FIG. 2 to FIG. 4, two tail ends of the two connecting portions 201 of the two detection terminals 22 extend towards each other, and then extend sideward to a front surface of the first extension portion 7021 of the grounding element 72 to form two second extension portions 2011. The two second extension portions 2011 are disposed corresponding to each other along an up-down direction. The two second extension portions 2011 are aligned with each other. The two second extension portions 2011 of the two detection terminals 22 are contactless. Two tail ends of the two second extension portions 2011 are both connected to the front surface of the first extension portion 7021. The at least one resistor 6 is connected between the two second extension portions 2011.

Two pairs of the innermost charging terminals 21 are VBUS (Voltage Bus) terminals. Two pairs of the outermost charging terminals 21 are grounding terminals. Tail ends of the connecting portions 201 of the two pairs of the innermost charging terminals 21 which are positioned next to the two detection terminals 22 of the two rows extend face to face. The plurality of the terminals 2 have two third extension portions 2012. The two tail ends of the two connecting portions 201 of the two innermost charging terminals 21 of the upper row which are positioned next to two sides of the detection terminal 22 of the upper row are bent downward, and then are combined together and further extend sideward to a front surface of the soldering portion 702 of the conductive element 71 to form one third extension portion 2012. The two tail ends of the two connecting portions 201 of the two innermost charging terminals 21 of the lower row which are positioned next to two sides of the detection terminal 22 of the lower row are bent upward, and then are combined together and further extend sideward to the front surface of the soldering portion 702 of the conductive element 71 to form the other third extension portion 2012. Two tail ends of the two innermost charging terminals 21 of each row are combined to one of the two third extension portions 2012. The two third extension portions 2012 are disposed corresponding to each other along the up-down direction. The two third extension portions 2012 are aligned with each other. The two third extension portions 2012 are contactless. The two third extension portions 2012 are connected to the front surface of the soldering portion 702 of the conductive element 71.

Tail ends of the connecting portions 201 of the two pairs of the outermost charging terminals 21 of the two rows extend face to face. The plurality of the terminals 2 have two fourth extension portions 2013. The two tail ends of the two connecting portions 201 of the two outermost charging terminals 21 of the upper row are bent downward, and then are combined together and further extend sideward to a front surface of the soldering portion 702 of the grounding element 72 to form one fourth extension portion 2013. The two tail ends of the two connecting portions 201 of the two outermost charging terminals 21 of the lower row are bent upward, and then are combined together and further extend sideward to the front surface of the soldering portion 702 of the grounding element 72 to form the other fourth extension portion 2013. Two tail ends of the two outermost charging terminals 21 of each row are combined to one of the two fourth extension portions 2013. The two fourth extension portions 2013 are contactless. The two fourth extension portions 2013 are disposed corresponding to each other along the up-down direction. The two fourth extension portions 2013 are aligned with each other. The two fourth extension portions 2013 are connected to the front surface of the soldering portion 702 of the grounding element 72.

Figure 15:
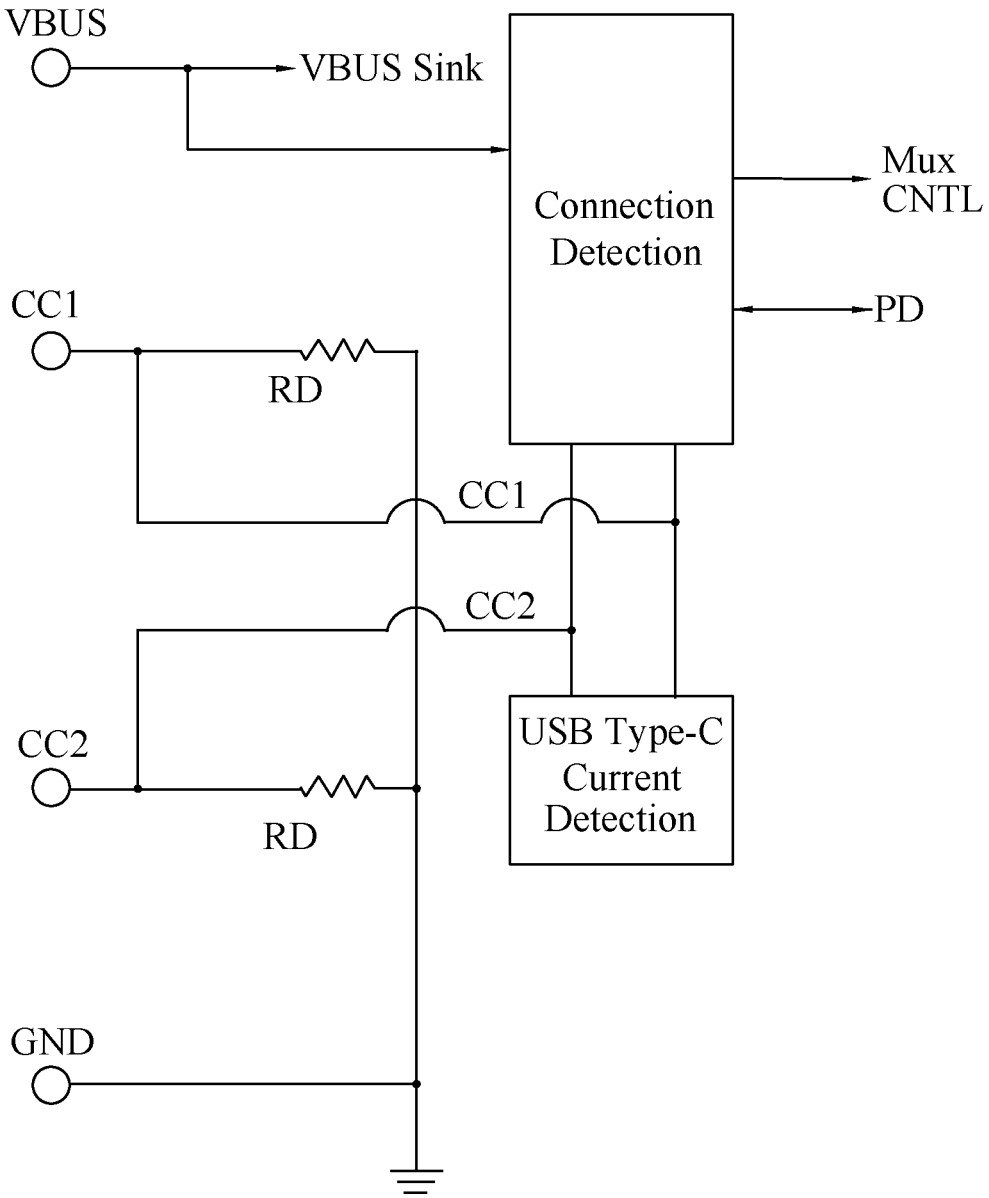
FIG. 15 (Prior Art)
FIG. 15 is a circuit diagram of a USB Type-C sink configuration channel functional model.

One side of a rear edge of the shell 4 extends rearward to form a grounding part 42. The grounding part 42 is directly connected to the grounding pin. The grounding part 42 is connected to one side of the front surface of the blocking wall 701 of the grounding element 72, so that the grounding element 72 has a grounded effect. The grounding element 72 is grounded to meet a specification of a USB (Universal Serial Bus) Type C Sink Configuration Channel Functional Model. In the circuit diagram shown in FIG. 15, CC1 which is a configuration channel is connected with a resistance RD, and CC1 is connected with a module of connection detection and a module of USB Type-C current detection. CC2 which is another configuration channel is connected with another resistance RD, and CC2 is connected with the module of connection detection and the module of USB Type-C current detection. The module of connection detection is connected among VBUS (Voltage Bus), Mux CNTL (Multiplexer Controller) and PD (Power Delivery). When a USB Type-C plug (not shown) is inserted into the waterproof socket connector 100, CC1 and CC2 are used for detecting a mode of the USB Type-C plug. The mode of the USB Type-C plug is a signal mode, a power mode or a PD (Power Delivery) mode. GND is defined as a ground.

Referring to FIG. 1 to FIG. 5, specific steps of a process of manufacturing the waterproof socket connector 100 in accordance with the first preferred embodiment are described as follow. Firstly, assemble the inner insulator 1, the terminals 2, the reinforcement plate 3 and the shell 4, and then solder the at least one resistor 6 to the two second extension portions 2011 manually. Then, solder the conductive element 71 to the two third extension portions 2012 manually, and solder the first extension portion 7021 of the grounding element 72 to the two second extension portions 2011 manually, solder the two fourth extension portions 2013 to the soldering portion 702 of the grounding element 72 manually, and solder the grounding part 42 to the front surface of the blocking wall 701 of the grounding element 72 manually. Later, fill the sealing element 53 into the inner space 41 by an adhesive dispensing way. At last, the outer insulator 8 is molded to the inner insulator 1, the plurality of the terminals 2, the reinforcement plate 3, the shell 4, the sealing element 53, the at least one resistor 6, the front end of the conductive element 71 and the front end of the grounding element 72 by means of an over molding technology, and the outer insulator 8 surrounds the inner insulator 1, the plurality of the terminals 2, the reinforcement plate 3, the shell 4, the sealing element 53, the at least one resistor 6, the front end of the conductive element 71 and the front end of the grounding element 72. So the waterproof socket connector 100 completes being manufactured.

Figure 6:
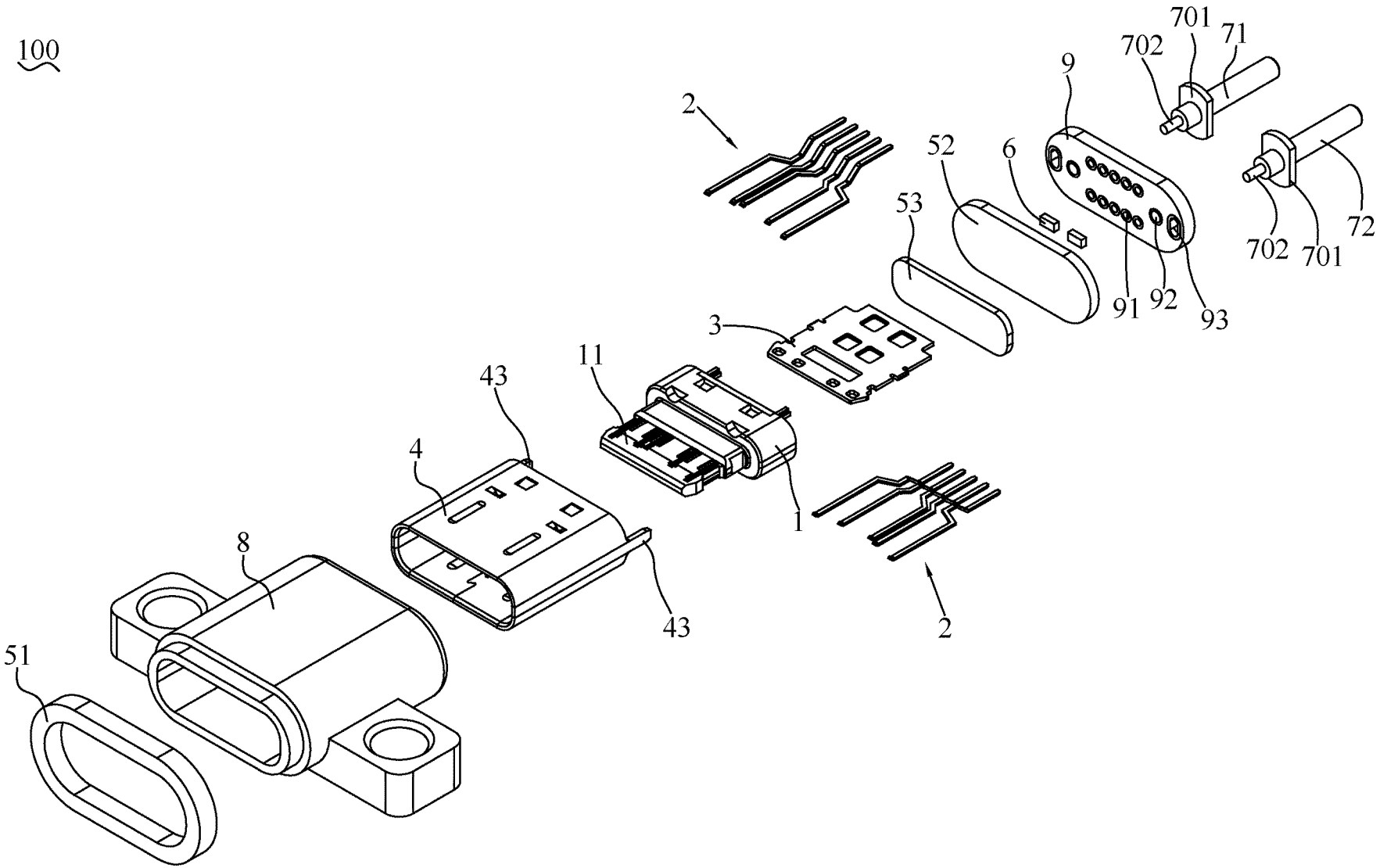
FIG. 6 is an exploded view of the waterproof socket connector in accordance with a second preferred embodiment of the present invention.

Referring to FIG. 1 and FIG. 6, the waterproof socket connector 100 in accordance with a second preferred embodiment of the present invention is shown. In the second preferred embodiment, the waterproof socket connector 100 further includes a circuit board 9. The at least one resistor 6 is fastened to the circuit board 9. The tail ends of the plurality of the terminals 2 extend rearward to form the plurality of the connecting portions 201. The circuit board 9 is mounted among the plurality of the terminals 2, the conductive element 71 and the grounding element 72. A circuitry arranged at the circuit board 9 is used for guiding a connection among the plurality of the terminals 2, the conductive element 71 and the grounding element 72, so that a complex forming way of manufacturing the plurality of the terminals 2 in accordance with the first preferred embodiment is simplified, and a simplified connecting way of the plurality of the terminals 2, the conductive element 71 and the grounding element 72 by the circuit board 9 also meets the specification of the USB Type C Sink Configuration Channel Functional Model.

Figure 7:
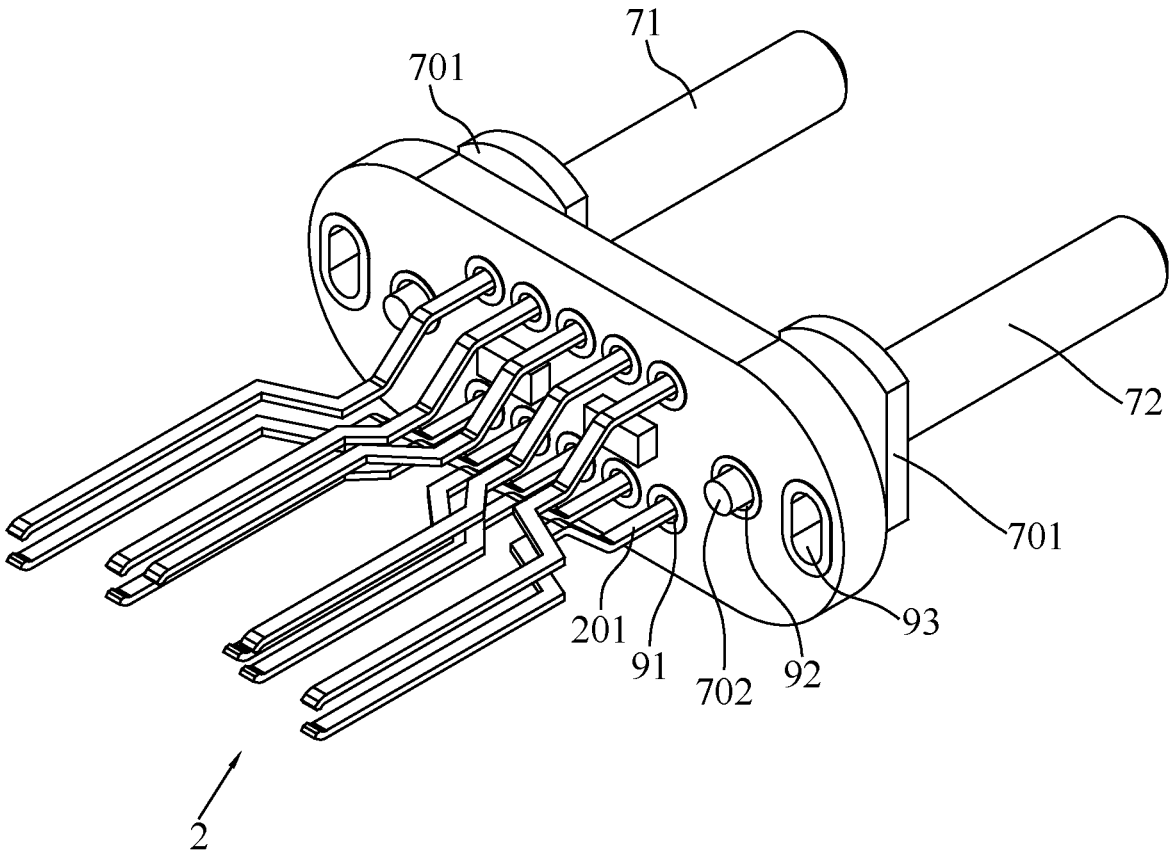
FIG. 7 is a partial assembling view of the waterproof socket connector, wherein the plurality of the terminals are assembled with a circuit board, a conductive element and a ground element of the waterproof socket connector of FIG. 6.

Referring to FIG. 6 and FIG. 7, the circuit board 9 is mounted behind the inner insulator 1. The circuit board 9 is mounted to the tail ends of the plurality of the terminals 2, and the circuit board 9 is connected with the connecting portions 201 of the plurality of the terminals 2. The circuit board 9 has a plurality of first perforations 91, two second perforations 92 and at least two third perforations 93. The plurality of the first perforations 91 penetrate through a middle of the circuit board 9. The two second perforations 92 penetrate through two sides of the circuit board 9. The connecting portions 201 of the plurality of the terminals 2 pass through the plurality of the first perforations 91, and the connecting portions 201 of the plurality of the terminals 2 are soldered to the circuit board 9. The plurality of the first perforations 91 are located between the two second perforations 92. A middle of a front surface of each of the conductive element 71 and the grounding element 72 extends frontward to form the soldering portion 702. The conductive element 71 and the grounding element 72 are mounted to a rear of the circuit board 9, and the conductive element 71 and the grounding element 72 are connected to the circuit board 9. The two soldering portions 702 of the conductive element 71 and the grounding element 72 pass through the two second perforations 92, and the two soldering portions 702 of the conductive element 71 and the grounding element 71 are soldered to the circuit board 9.

The periphery of the front end of each of the conductive element 71 and the grounding element 72 protrudes outward to form the blocking wall 701. After the outer insulator 8 is molded to the two blocking walls 701 of the conductive element 71 and the grounding element 72, the outer insulator 8 surrounds the two blocking walls 701 of the conductive element 71 and the grounding element 72, the two blocking walls 701 of the conductive element 71 and the grounding element 72 prevent the conductive element 71 and the grounding element 72 breaking away from the outer insulator 8, so that the conductive element 71 and the grounding element 72 keeps being fixed in the outer insulator 8.

In the second embodiment, the waterproof socket connector 100 includes two resistors 6. The two resistors 6 are soldered to the circuit board 9 by tin. The circuit board 9 has the circuitry (not shown). The two resistors 6 and the two detection terminals 22 are soldered to the circuit board 9, so that the two resistors 6 are connected in series with the two detection terminals 22 respectively by the circuitry.

The at least two third perforations 93 penetrate through the two sides of the circuit board 9. The at least two third perforations 93 are adjacent to two outer sides of the two second perforations 92. Preferably, the circuit board 9 has two third perforations 93. The plurality of the first perforations 91 and the two second perforations 92 are located between the two third perforations 93. At least two portions of two sides of the rear end of the shell 4 extend rearward to form at least two fixing plates 43. Preferably, the two sides of the rear end of the shell 4 extend rearward to form two fixing plates 43. Each fixing plate 43 passes through one third perforation 93, and each fixing plate 43 is soldered to the circuit board 9, so that the circuit board 9 is fastened to the rear end of the shell 4.

Figure 8:
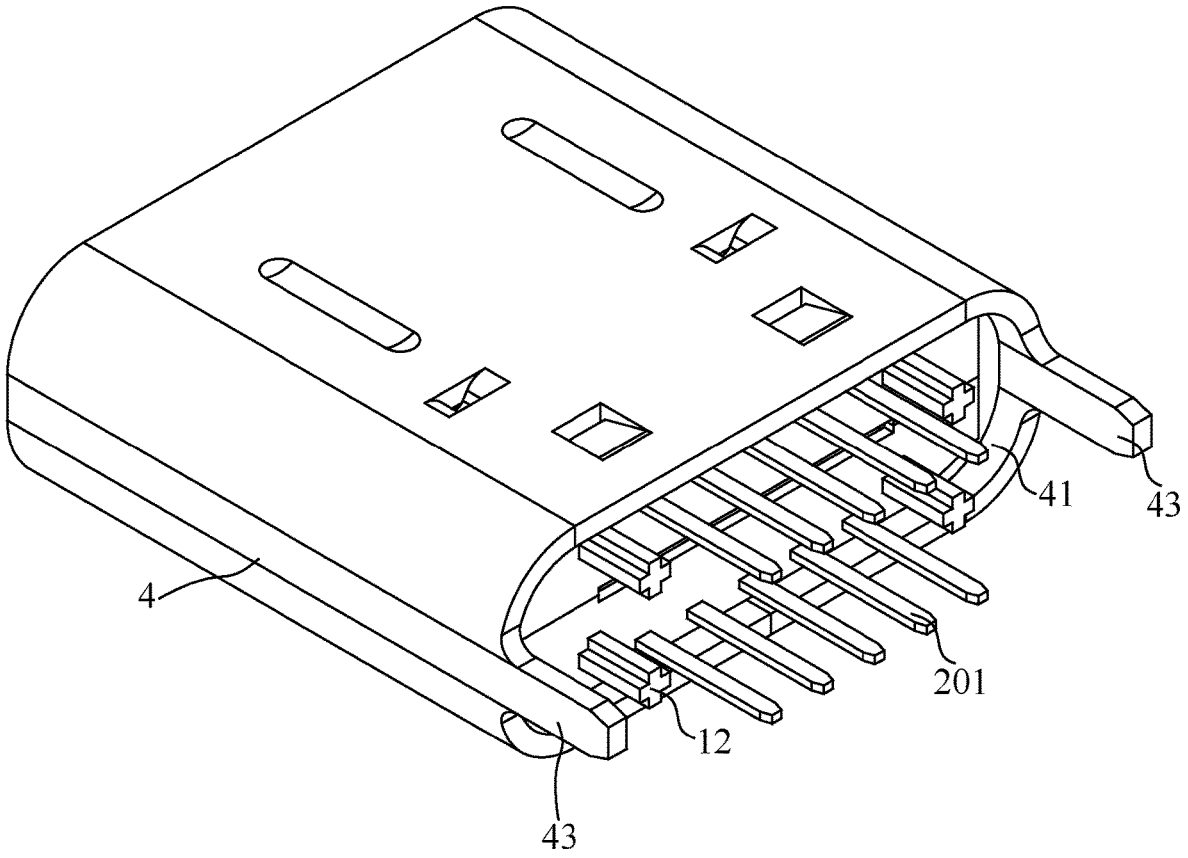
FIG. 8 is a partial assembling view showing that the sealing element is without being filled in the waterproof socket connector of FIG. 6.
Figure 9:
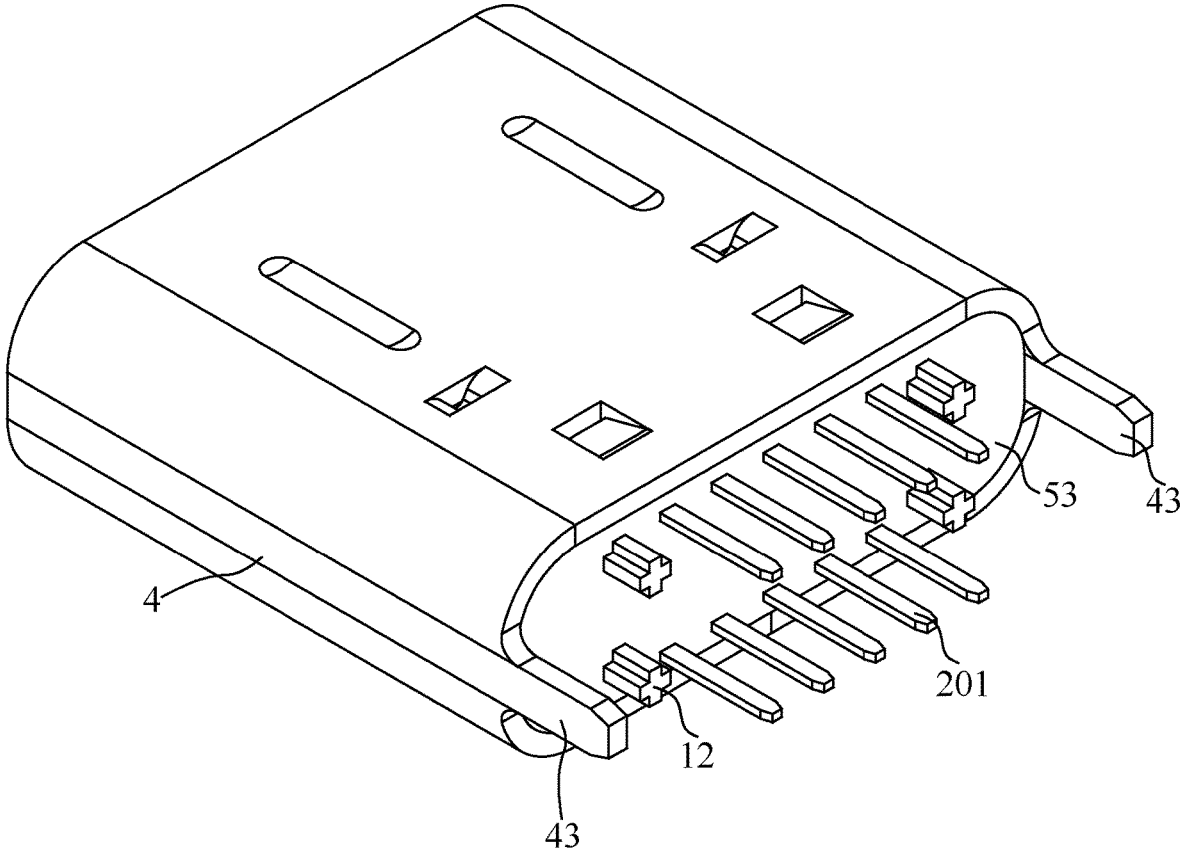
FIG. 9 is a partial assembling view showing that the sealing element is filled in the waterproof socket connector of FIG. 6.
Figure 10:
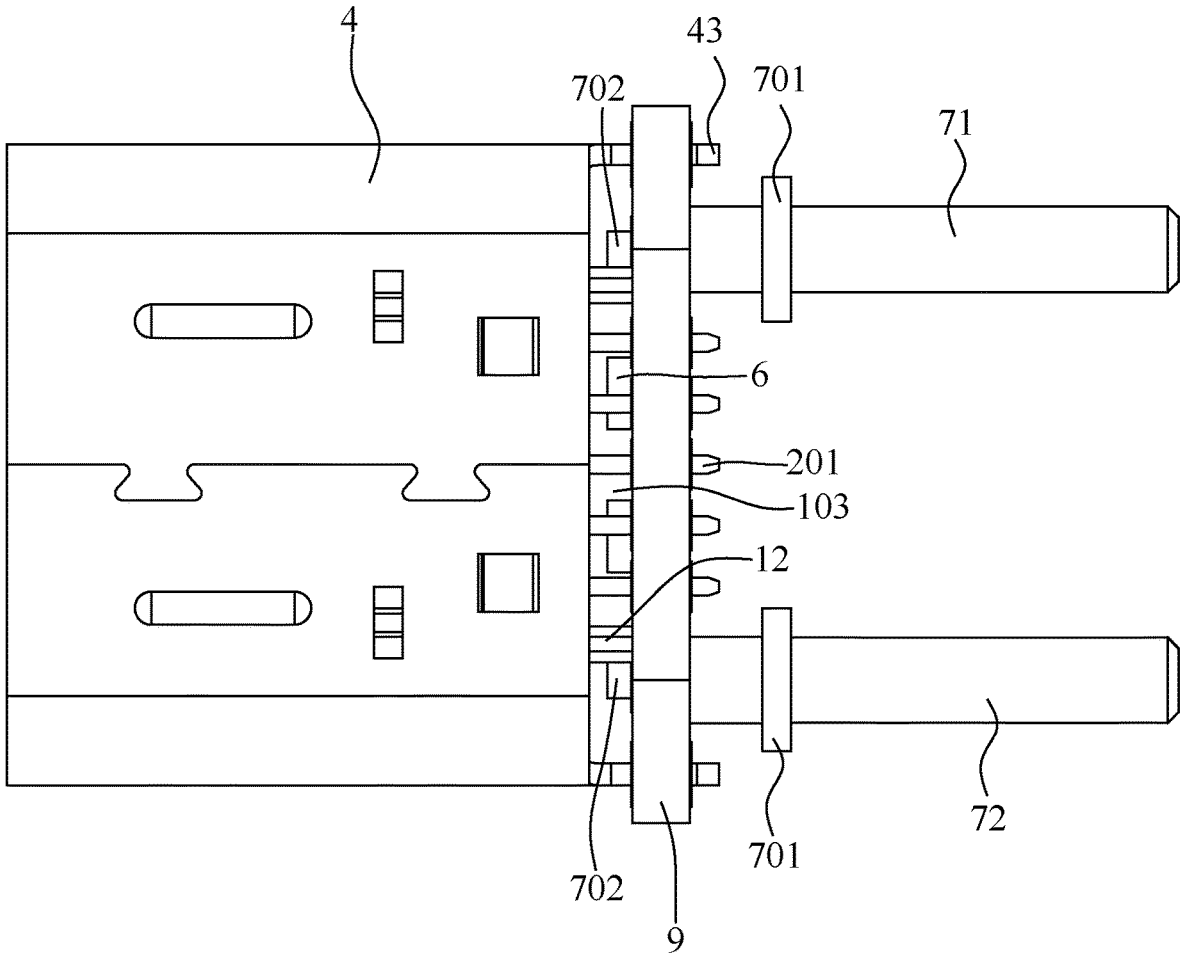
FIG. 10 is a bottom view showing that an outer waterproof body is without being filled in the waterproof socket connector of FIG. 6.

Referring to FIG. 8 and FIG. 10, several portions of the rear surface of the inner insulator 1 protrude rearward to form a plurality of limiting portions 12. The plurality of the limiting portions 12 contact with the circuit board 9. The plurality of the limiting portions 12 abut against a front surface of the circuit board 9. A rear surface of the shell 4 is flush with a rear surface of the sealing element 53. The circuit board 9 is spaced from the shell 4 to form a clearance 103 between the circuit board 9 and the shell 4. The two resistors 6 are soldered to an inner surface of the circuit board 9 by a surface mount technology. The soldering portion 702 of the conductive element 71 and the soldering portion 702 of the grounding element 72 are soldered to the inner surface of the circuit board 9 through the clearance 103. The connecting portions 201 of the plurality of the terminals 2 are soldered to an outer surface of the circuit board 9.

Figure 11:
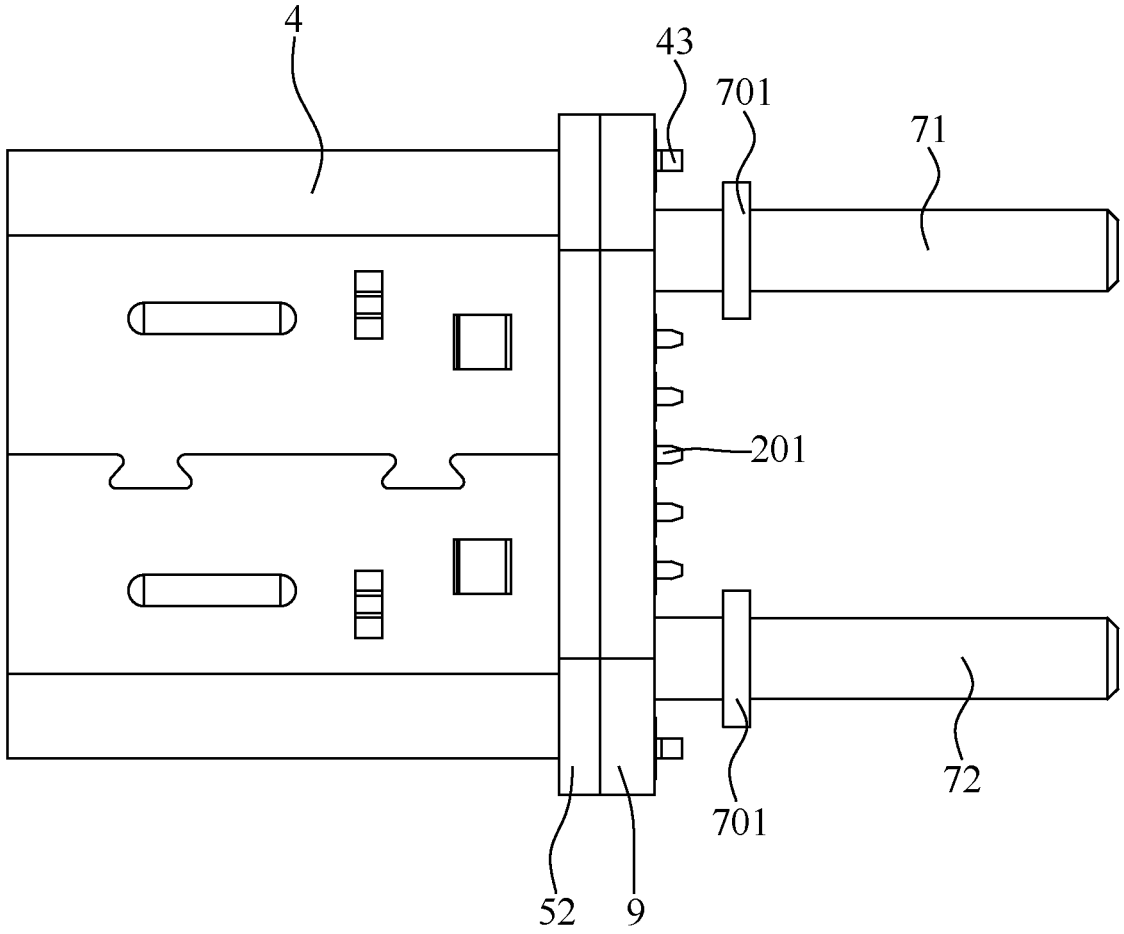
FIG. 11 is a bottom view showing that the outer waterproof body is filled in the waterproof socket connector of FIG. 6.

Referring to FIG. 6 and FIG. 11, in the second preferred embodiment, the waterproof socket connector 100 further includes a waterproof element 52. The waterproof element 52 is arranged among a rear end of the base body 13 of the inner insulator 1, the rear surface of the sealing element 53, the rear end of the shell 4 and the front surface of the circuit board 9. A front surface of the waterproof element 52 abuts against the rear surface of the sealing element 53 and the rear surface of the shell 4, and a rear surface of the waterproof element 52 abuts against the front surface of the circuit board 9. The waterproof element 52 surrounds the rear end of the shell 4, front ends of the connecting portions 201 of the plurality of the terminals 2, the at least one resistor 6 and front ends of the two soldering portions 702 of the conductive element 71 and the grounding element 72. The waterproof element 52 seals up interspaces among the rear end of the shell 4, the rear surface of the sealing element 53, the front ends of the connecting portions 201 of the plurality of the terminals 2, the at least one resistor 6, the front end of the soldering portion 702 of the conductive element 71, the front end of the soldering portion 702 of the grounding element 72 and the circuit board 9. An outer periphery surface of the waterproof element 52 is aligned with an outer periphery surface of the circuit board 9. The waterproof element 52 is a curing adhesive.

Referring to FIG. 6 to FIG. 11, specific steps of a process of manufacturing the waterproof socket connector 100 in accordance with the second preferred embodiment are described as follows. At first, assemble the inner insulator 1, the plurality of the terminals 2, the reinforcement plate 3 and the shell 4, and then inject the sealing element 53 into the inner space 41 by a glue dispensing way. The waterproof socket connector 100 reaches a waterproof effect of IPX7 (International General Waterproof Grade). Then mount the connecting portions 201 of the plurality of the terminals 2 and the two soldering portions 702 of the conductive element 71 and the grounding element 72 to the circuit board 9 together with the two resistors 6 by a Dual in-Line Package Process (DIP), and solder the connecting portions 201 of the plurality of the terminals 2 and the two soldering portions 702 of the conductive element 71 and the grounding element 72 to the circuit board 9 together with the two resistors 6, so the connecting portions 201 of the plurality of the terminals 2, the two resistors 6, and the two soldering portions 702 of the conductive element 71 and the grounding element 72 are connected with the circuit board 9.

Later, the waterproof element 52 fills the interspaces among the rear surface of the sealing element 53, the rear end of the shell 4, the front ends of the connecting portions 201 of the plurality of the terminals 2, the two resistors 6, the front end of the soldering portion 702 of the conductive element 71, the front end of the soldering portion 702 of the grounding element 72 and the circuit board 9, and the waterproof element 52 further seals up the interspaces among the rear surface of the sealing element 53, the rear end of the shell 4, the front ends of the connecting portions 201 of the plurality of the terminals 2, the two resistors 6, the front end of the soldering portion 702 of the conductive element 71, the front end of the soldering portion 702 of the grounding element 72 and the circuit board 9 to achieve the waterproof effect of the waterproof socket connector 100. In the end, the outer insulator 8 is molded to the inner insulator 1, the plurality of the terminals 2, the reinforcement plate 3, the shell 4, the waterproof element 52, the two resistors 6, the circuit board 9, the two soldering portions 702 and the two blocking walls 701 of the conductive element 71 and the grounding element 72 by means of the over molding technology, and the outer insulator 8 surrounds the inner insulator 1, the plurality of the terminals 2, the reinforcement plate 3, the shell 4, the waterproof element 52, the sealing element 53, the circuit board 9, the at least one resistor 6, the soldering portion 702 and the blocking wall 701 of the front end of the conductive element 71 and the soldering portion 702 and the blocking wall 701 of the front end of the grounding element 72. So that the waterproof socket connector 100 completes being manufactured.

Figure 12:
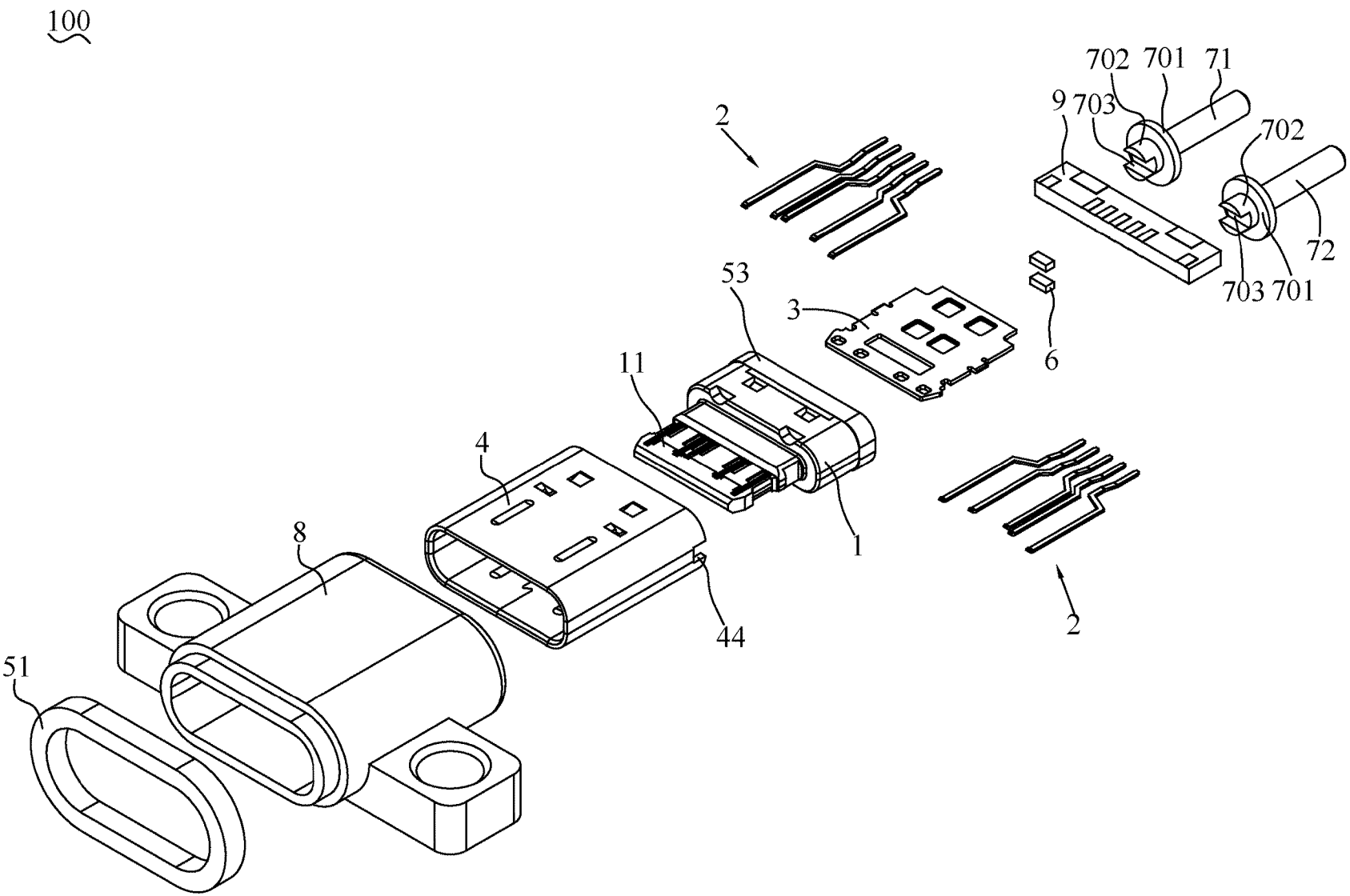
FIG. 12 is an exploded view of the waterproof socket connector in accordance with a third preferred embodiment of the present invention.

Referring to FIG. 12, the waterproof socket connector 100 in accordance with a third preferred embodiment of the present invention is shown. In the third preferred embodiment, the waterproof socket connector 100 further includes the circuit board 9. The tail ends of the plurality of the terminals 2 extend rearward to form the plurality of the connecting portions 201. The circuit board 9 is mounted among the plurality of the terminals 2, the conductive element 71 and the grounding element 72. The conductive element 71 and the grounding element 72 are connected to the at least one resistor 6 and the plurality of the terminals 2 by the circuitry of the circuit board 9. The circuitry arranged at the circuit board 9 is used for guiding the connection among the plurality of the terminals 2, the conductive element 71 and the grounding element 72, so that the complex forming way of manufacturing the plurality of the terminals 2 in accordance with the first preferred embodiment is simplified, and the simplified connecting way of the plurality of the terminals 2, the conductive element 71 and the grounding element 72 by the circuit board 9 meets the specification of the USB Type C Sink Configuration Channel Functional Model.

Figure 13:
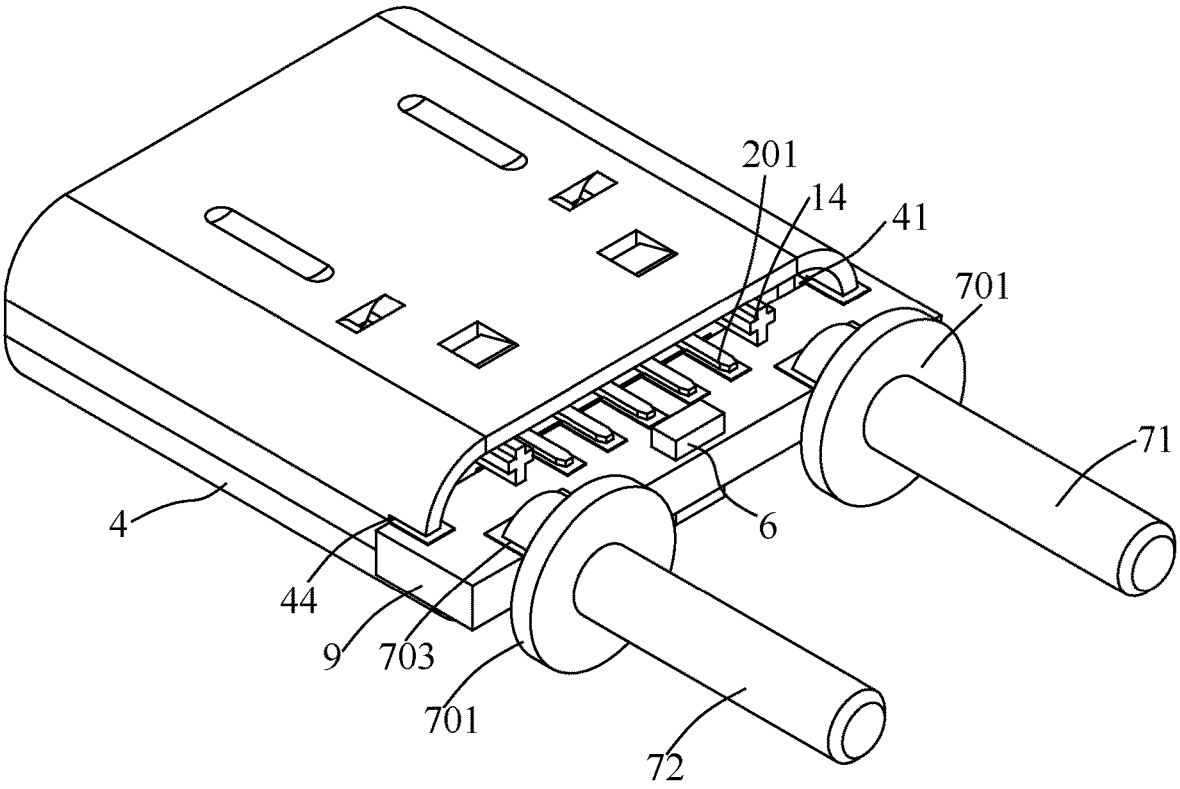
FIG. 13 is a partial assembling view showing that the sealing element is without being filled in the waterproof socket connector of FIG. 12.

Referring to FIG. 12 and FIG. 13, the periphery of the front end of each of the conductive element 71 and the grounding element 72 protrudes outward to form the blocking wall 701. The two front ends of the conductive element 71 and the grounding element 72 protrude frontward to form two soldering portions 702 projecting beyond the two front surfaces of the two blocking walls 701. Two middles of two front surfaces of the two front ends of the conductive element 71 and the grounding element 72 are recessed rearward to form two clamping grooves 703. Two middles of two front surfaces of the two soldering portions 702 of the conductive element 71 and the grounding element 72 are recessed rearward to form the two clamping grooves 703. After the outer insulator 8 is molded to the two blocking walls 701 of the conductive element 71 and the grounding element 72, the outer insulator 8 surrounds the blocking walls 701 of the conductive element 71 and the grounding element 72, the two blocking walls 701 prevent the conductive element 71 and the grounding element 72 from breaking away from the outer insulator 8 so as to maintain fastening the two front ends of the conductive element 71 and the grounding element 72 in the outer insulator 8.

Two opposite sides of a rear end edge of the shell 4 are recessed inward to form two fixing slots 44 formed at two sides of the shell 4. The circuit board 9 is fixed in the two fixing slots 44 of the shell 4 horizontally. One end of the circuit board 9 is clamped between the connecting portions 201 of the two rows of the terminals 2. The connecting portions 201 of the plurality of the terminals 2 are soldered with the one end of the circuit board 9. The other end of the circuit board 9 is exposed outside of the shell 4. The two clamping grooves 703 of the conductive element 71 and the grounding element 72 clamp the other end of the circuit board 9, and side walls of the two clamping grooves 703 of the conductive element 71 and the grounding element 72 are soldered to the other end of the circuit board 9, specifically, the two soldering portions 702 of the conductive element 71 and the grounding element 72 are soldered to the other end of the circuit board 9.

Several portions of the rear surface of the inner insulator 1 protrude rearward to form a plurality of positioning parts 14. The plurality of the positioning parts 14 are arranged in two rows. The two rows of the plurality of the positioning parts 14 are arranged along the up-down direction. An upper row of the positioning parts 14 are corresponding to a lower row of the positioning parts 14. The upper row of the positioning parts 14 cooperate with the lower row of the positioning parts 14. When the one end of the circuit board 9 is assembled into the two fixing slots 44, the two rows of the positioning parts 14 clamp the one end of the circuit board 9, and the one end of the circuit board 9 is stably assembled to the rear end of the inner insulator 1 so as to proceed with a soldering operation between the plurality of the terminals 2 and the circuit board 9 conveniently.

Figure 14:
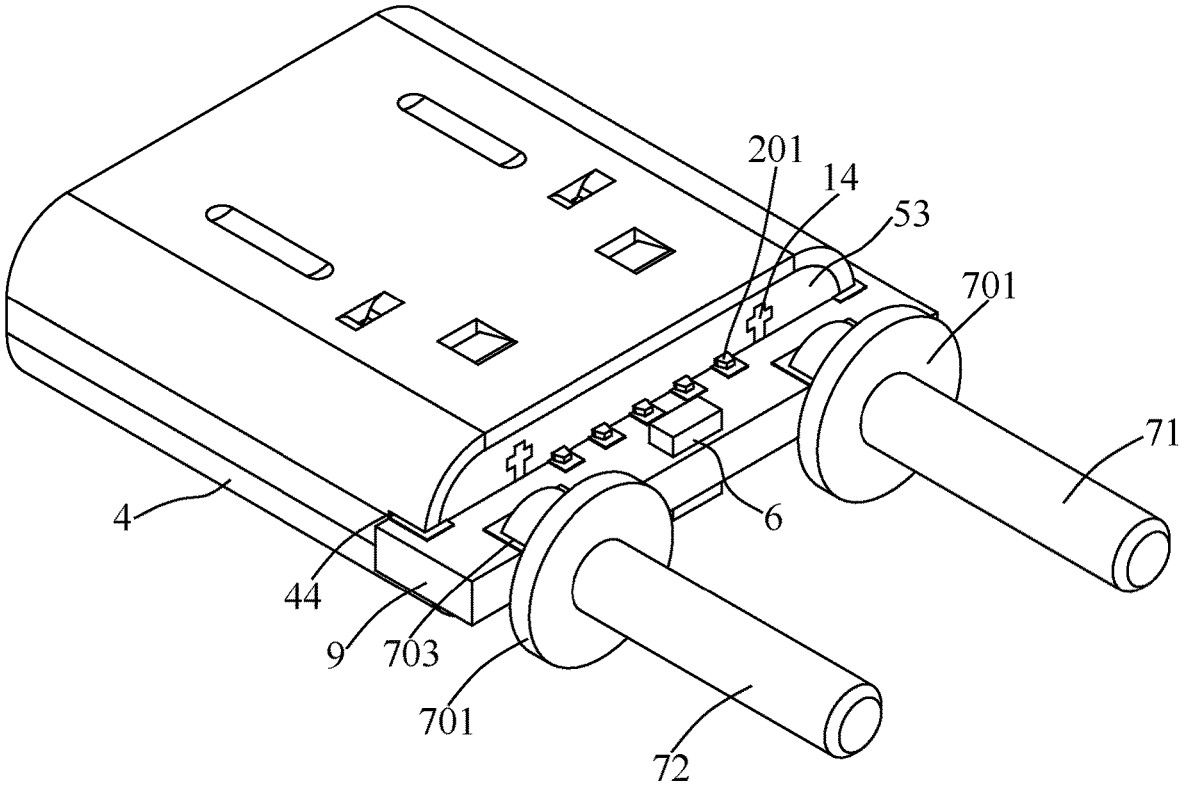
FIG. 14 is a partial assembling view showing that the sealing element is filled in the waterproof socket connector of FIG. 12.

Referring to FIG. 12 to FIG. 14, specific steps of a process of manufacturing the waterproof socket connector 100 in accordance with the third preferred embodiment are described as follows. At first, assemble the inner insulator 1, the plurality of the terminals 2, the reinforcement plate 3 and the shell 4, and assemble the circuit board 9 to the rear end of the shell 4, after the two clamping grooves 703 of the conductive element 71 and the grounding element 72 clamp the circuit board 9, coat solder paste to connecting positions between the connecting portions 201 of the plurality of the terminals 2 and the one end of the circuit board 9, and coat the solder paste to connecting positions between side walls of the two clamping grooves 703 of the conductive element 71 and the grounding element 72, and the other end of the circuit board 9.

Then, the waterproof socket connector 100 proceeds with the SMT (Surface Mount Technology) procedure, the connecting positions between the connecting portions 201 of the plurality of the terminals 2 and the one end of the circuit board 9 are soldered by the SMT (Surface Mount Technology) procedure, in the same way, the connecting positions between the side walls of the two clamping grooves 703 of the conductive element 71 and the grounding element 72, and the other end of the circuit board 9 are soldered by the SMT (Surface Mount Technology) procedure. Later, inject the sealing element 53 into the inner space 41 by the glue dispensing way to achieve the waterproof effect.

At last, the outer insulator 8 is molded to the inner insulator 1, the plurality of the terminals 2, the reinforcement plate 3, the shell 4, the sealing element 53, the two resistors 6, the circuit board 9, the two soldering portions 702 and the two blocking walls 701 of the conductive element 71 and the grounding element 72 by means of the over molding technology, and the outer insulator 8 surrounds the inner insulator 1, the plurality of the terminals 2, the reinforcement plate 3, the shell 4, the waterproof element 52, the two resistors 6, the circuit board 9, the two soldering portions 702 and the two blocking walls 701 of the conductive element 71 and the grounding element 72. So that the waterproof socket connector 100 completes being manufactured.

When the waterproof socket connector 100 just needs a charging function, the plurality of the terminals 2 are integrated to the conductive element 71 and the grounding element 72 by the circuitry of the circuit board 9. The conductive element 71 and the grounding element 72 have a positive electrode function and a negative electrode function, respectively. The USB Type-C plug has a positive electrode function requirement and a negative electrode function requirement. The USB Type-C plug is matched with the waterproof socket connector 100 to be used by a user, so that the positive electrode function requirement and the negative electrode function requirement of the USB Type-C plug are realized. The waterproof socket connector 100 reaches the waterproof effect of IPX7 (International General Waterproof Grade) by virtue of the outer insulator 8.

As described above, the conductive element 71 and the grounding element 72 of the waterproof socket connector 100 are connected to the at least one resistor 6 and the plurality of the terminals 2 of the waterproof socket connector 100 directly or the conductive element 71 and the grounding element 72 are connected to the at least one resistor 6 and the plurality of the terminals 2 through the circuit board 9, so the waterproof socket connector 100 not only has a waterproof function and the charging function, but also is easy to be assembled with the electronic device.

What is claimed is:

1. A waterproof socket connector, comprising:

an inner insulator having a tongue board;

a plurality of terminals fastened in the inner insulator, the plurality of the terminals are ten terminals, five terminals are arranged in the upper row, and the other five terminals are arranged in the lower row, the upper row of the terminals are disposed corresponding to the lower row of the terminals, the plurality of the terminals include eight charging terminals and two detection terminals, each row of the terminals include four charging terminals and one detection terminal, each detection terminal is located in a middle of the plurality of the terminals, so each side of the detection terminal of each row is disposed adjacent to two charging terminals;

at least one resistor mounted to the connecting portions of the detection terminals;

a conductive element mounted behind the plurality of the terminals, several of the charging terminals being connected to the conductive element;

a grounding element mounted behind the plurality of the terminals, the detection terminals being connected to the grounding element, remains of the charging terminals being connected to the grounding element;

a shell, a front end of the shell surrounding the inner insulator, a rear end of the shell being hollow to form an inner space between a rear end of the inner insulator and the rear end of the shell, one side of a rear edge of the shell extending rearward to form a grounding part, the grounding part being connected to the grounding element;

a sealing element filled in the inner space; and an outer insulator surrounding the inner insulator, the plurality of the terminals, the shell, the sealing element, the at least one resistor, a front end of the conductive element and a front end of the grounding element.

2. The waterproof socket connector as claimed in claim 1, wherein a periphery of a front end of each of the conductive element and the grounding element has a blocking wall protruding outward, the two front ends of the conductive element and the grounding element protrude frontward to form two soldering portions projecting beyond two front surfaces of the two blocking walls of the conductive element and the grounding element, a middle of the soldering portion of the grounding element extends frontward to form a first extension portion.

3. The waterproof socket connector as claimed in claim 2, wherein the grounding part is connected to one side of the front surface of the blocking wall of the grounding element.

4. The waterproof socket connector as claimed in claim 2, wherein two tail ends of the two connecting portions of the two detection terminals extend towards each other, and then extend sideward to a front surface of the first extension portion of the grounding element to form two second extension portions, the two second extension portions of the two detection terminals are contactless, two tail ends of the two second extension portions are both connected to the front surface of the first extension portion, the at least one resistor is connected between the two second extension portions.

5. The waterproof socket connector as claimed in claim 4, wherein the two second extension portions are disposed corresponding to each other along an up-down direction, the two second extension portions are aligned with each other.

6. The waterproof socket connector as claimed in claim 4, wherein the plurality of the terminals have two third extension portions, two tail ends of the two connecting portions of the two innermost charging terminals of the upper row which are positioned next to two sides of the detection terminal of the upper row are bent downward, and then are combined together and further extend sideward to a front surface of the soldering portion of the conductive element to form one third extension portion, two tail ends of the two connecting portions of the two innermost charging terminals of the lower row which are positioned next to two sides of the detection terminal of the lower row are bent upward, and then are combined together and further extend sideward to the front surface of the soldering portion of the conductive element to form the other third extension portion, two tail ends of the two innermost charging terminals of each row are combined to one of the two third extension portions, the two third extension portions are contactless, the two third extension portions are connected to the front surface of the soldering portion of the conductive element.

7. The waterproof socket connector as claimed in claim 6, wherein the two third extension portions are disposed corresponding to each other along an up-down direction, the two third extension portions are aligned with each other.

8. The waterproof socket connector as claimed in claim 6, wherein the plurality of the terminals have two fourth extension portions, two tail ends of the two connecting portions of the two outermost charging terminals of the upper row are bent downward, and then are combined together and further extend sideward to a front surface of the soldering portion of the grounding element to form one fourth extension portion, two tail ends of the two connecting portions of the two outermost charging terminals of the lower row are bent upward, and then are combined together and further extend sideward to the front surface of the soldering portion of the grounding element to form the other fourth extension portion, two tail ends of the two outermost charging terminals of each row are combined to one of the two fourth extension portions, the two fourth extension portions are contactless, the two fourth extension portions are connected to the front surface of the soldering portion of the grounding element.

9. The waterproof socket connector as claimed in claim 8, wherein the two fourth extension portions are disposed corresponding to each other along an up-down direction, the two fourth extension portions are aligned with each other.

10. A waterproof socket connector, comprising:

an inner insulator having a tongue board;

a plurality of terminals fastened in the inner insulator, the plurality of the terminals being arranged in an upper row and a lower row, respectively, the upper row of the terminals being exposed outside from an upper surface of the tongue board, the lower row of the terminals being exposed outside from a lower surface of the tongue board, a tail end of each terminal having a connecting portion, and each connecting portion projecting outward from a rear surface of the inner insulator, the plurality of the terminals being a plurality of charging terminals and detection terminals;

a circuit board mounted to the tail ends of the plurality of the terminals, and the circuit board has a plurality of first perforations, the plurality of the first perforations penetrate through a middle of the circuit board, the connecting portions of the plurality of the terminals pass through the plurality of the first perforations, and the connecting portions of the plurality of the terminals are soldered to the circuit board;

at least one resistor fastened to the circuit board;

a conductive element mounted to a rear of the circuit board, and the conductive element being connected to the circuit board;

a grounding element mounted to the rear of the circuit board, and the grounding element being connected to the circuit board;

a shell, a front end of the shell surrounding the inner insulator, a rear end of the shell being hollow to form an inner space between a rear end of the inner insulator and the rear end of the shell;

a sealing element filled in the inner space; and an outer insulator surrounding the inner insulator, the plurality of the terminals, the shell, the sealing element, the circuit board, the at least one resistor, a front end of the conductive element and a front end of the grounding element.

11. The waterproof socket connector as claimed in claim 10, wherein the circuit board has two second perforations, the two second perforations penetrate through two sides of the circuit board, the plurality of the first perforations are located between the two second perforations, a middle of a front surface of each of the conductive element and the grounding element extends frontward to form a soldering portion, the two soldering portions of the conductive element and the grounding element pass through the two second perforations, and the two soldering portions of the conductive element and the grounding element are soldered to the circuit board.

12. The waterproof socket connector as claimed in claim 11, wherein the circuit board has at least two third perforations, the at least two third perforations penetrate through the two sides of the circuit board, the at least two third perforations are adjacent to two outer sides of the two second perforations, at least two portions of two sides of the rear end of the shell extend rearward to form at least two fixing plates, each fixing plate passes through one third perforation, and each fixing plate is soldered to the circuit board.

13. The waterproof socket connector as claimed in claim 10, further comprising a waterproof element, the waterproof element being arranged among a rear surface of the sealing element, the rear end of the shell and a front surface of the circuit board, the waterproof element surrounding the rear end of the shell, front ends of the connecting portions of the plurality of the terminals, the at least one resistor and front ends of the two soldering portions of the conductive element and the grounding element, the waterproof element sealing up interspaces among the rear end of the shell, the rear surface of the sealing element, the front ends of the connecting portions of the plurality of the terminals, the at least one resistor, the front end of the soldering portion of the conductive element, the front end of the soldering portion of the grounding element and the circuit board.

14. The waterproof socket connector as claimed in claim 10, wherein a periphery of the front end of each of the conductive element and the grounding element protrudes outward to form a blocking wall, the two blocking walls of the conductive element and the grounding element are molded in the outer insulator.

15. The waterproof socket connector as claimed in claim 10, wherein several portions of the rear surface of the inner insulator protrude rearward to form a plurality of limiting portions, the plurality of the limiting portions abut against a front surface of the circuit board.

16. The waterproof socket connector as claimed in claim 10, wherein two middles of two front surfaces of the two front ends of the conductive element and the grounding element are recessed rearward to form two clamping grooves, two opposite sides of a rear end edge of the shell are recessed inward to form two fixing slots, the circuit board is fixed in the two fixing slots of the shell horizontally, one end of the circuit board is clamped between the connecting portions of the two rows of the terminals, the other end of the circuit board is exposed outside of the shell, the connecting portions of the plurality of the terminals are soldered with the one end of the circuit board, the two clamping grooves of the conductive element and the grounding element clamp the other end of the circuit board, and side walls of the two clamping grooves of the conductive element and the grounding element are soldered to the other end of the circuit board.

17. The waterproof socket connector as claimed in claim 10, wherein several portions of the rear surface of the inner insulator protrude rearward to form a plurality of positioning parts, the plurality of the positioning parts are arranged in two rows, the two rows of the plurality of the positioning parts are arranged along an up-down direction, an upper row of the positioning parts is corresponding to a lower row of the positioning parts, the upper row of the positioning parts cooperates with the lower row of the positioning parts, the two rows of the positioning parts clamp one end of the circuit board.

* * * * *